US005729922A

United States Patent [19]

Peterson et al.

[11] Patent Number: 5,729,922

[45] Date of Patent: Mar. 24, 1998

[54] MUG HAVING INTERCHANGEABLE INDICIA TILES

[76] Inventors: Bryan W. Peterson, 9960 Cross Pine Ct., Lake Worth, Fla. 33467; Arturo De Rojas, 9892-C Boca Gardens Trail, Boca Raton, Fla. 33496

[21] Appl. No.: 585,838

[22] Filed: Jan. 16, 1996

[51] Int. Cl.[6] ..... G09F 3/00

[52] U.S. Cl. ..... 40/324; 40/649

[58] Field of Search ..... 40/306, 310, 324, 40/649

[56] References Cited

U.S. PATENT DOCUMENTS

| | | | |
|---|---|---|---|
| 626,235 | 6/1899 | Hutton | 40/310 X |
| 1,554,191 | 9/1925 | Alexander | 40/310 |
| 3,514,887 | 6/1970 | Jacob | 40/324 |
| 4,263,734 | 4/1981 | Bradshaw | 40/324 |
| 4,713,900 | 12/1987 | Calloway, Jr. et al. | 40/324 |
| 5,024,014 | 6/1991 | Swierczek | 40/310 |
| 5,448,844 | 9/1995 | Miller, Jr. et al. | 40/306 X |

FOREIGN PATENT DOCUMENTS

| | | | |
|---|---|---|---|
| 206144 | 12/1920 | Canada | 40/310 |

*Primary Examiner*—Brian K. Green

*Attorney, Agent, or Firm*—Malin, Haley, DiMaggio & Crosby, PA

[57] ABSTRACT

A drinking vessel having an open face slot defined by the wall of the vessel for holding a selected tile from a plurality of interchangeable tiles bearing indicia for conveying a selected message, wherein the tiles have dimensions corresponding to the dimension of the slot for slidably engaging the slot, and whereby the tiles each have indicia embodying a different written expression or design such as a generic human face which is neutral with respect to gender, race, or nationality, and which is adapted to reflect a particular human mood, feeling, condition, or disposition.

21 Claims, 4 Drawing Sheets

MUG HAVING INTERCHANGEABLE INDICIA TILES

BACKGROUND OF THE INVENTION

1. Field of the Invention

This invention relates generally to drinking vessels, and more particularly, to a drinking cup or mug having interchangeable indicia on its outer surface for displaying an expression or message such as indicia for conveying the owner's particular disposition, feeling, or condition, or to make a personal statement.

2. Description of the Background Art

Cups and mugs which display graphic designs on their exterior are well known in the art. These mugs enjoy significant popularity in this country and abroad to the extent that they are commonly found in virtually every home and business. However, there appears to be no such mug which is adapted for interchangeably mounting different graphic designs or messages thereon to convey selected messages. Such a mug would be well received. Therefore, there exists a need for a mug having a built in capability for installing or removing various external graphic designs or messages and in particular, designs which embody differing aspects of the ever-changing human mood or personal opinion.

Several devices are contemplated in the background art for removably attaching indicia to the outside of a container. However, none of these references address a mug adapted for interchangeably mounting indicia tiles having different graphic designs or messages. For examples, Hosmer, U.S. Pat. No. 566,761, discloses an advertising device comprising a strip of paper extended around a bottle and including a transparent cover for protecting the paper's surface indicia. Jenison, U.S. Pat. No. 4,546,946, comprises a coaster having a removable support plate. Clagett, U.S. Pat. No. 2,689,424, discloses a dual indicia container comprising a substantially translucent colored mug painted with a picture, such as a smiling clown face, that is not visible while the mug is full and becomes visible once the mug is empty. The purpose of Clagett is to entice children to drink the fluid contained in the mug. None of these references teach mugs having means to easily interchange and select messages for display thereon.

Other references are known which contemplate milk bottles with exterior posckets for attaching tickets or disks. For instance, Alexander, U.S. Pat. No. 1,554,191 discloses an improvement in milk bottles comprising an indicia receiving pocket on a vertical wall thereof to receive and retain an indicia disk. The pocket is shown as formed with an annular collar or ring for pressing the disc therein. Gagnon, et al, Canadian Patent No. 206,144 discloses a milk bottle having a ticket holder integral with the bottle neck below the bottles lip wherein the ticket holder defines a recession in the neck of the milk bottle for receiving a ticket inserted therein. Alexander and Gagnon, et al are limited to milk bottle structures and indentifying the same.

A reference related mugs is also known, but it is limited to a method of manufacturing a mug with a permanently applied label and fails to address the concerns of the instant invention. Bradshaw, U.S. Pat. No. 4,263,734, discloses a method of making a ceramic cup with a recessed area from the top of the cup to the bottom for permanently adhering a sheet or strip therein. Bradshaw's method of manufacture not only wastes material during the, but it results in a mug that is not conducive for interchanging indicia pieces. Bradshaw wastes material in that the recessed area is carved from the exterior wall of the mug and the picture design is cut from a strip of material that leave excess material when done. The picture design cut from material is adhered in the recessed area of the mug by applying a glue, adhesive or cement to the back surface of the picture strip such that the picture strip is not removable once inserted in the wall of the recessed area. In contrast with the background art, the instant invention addresses and solves problems related to wasting material during the manufacturing process and designing a mug that facilitates the convenient interchanging of indicia pieces.

SUMMARY OF THE INVENTION

In accordance with the instant invention, there is provided a drinking cup designed with an installation slot or surface pocket for slidably mounting or removing a plurality of external sign means/tiles having surface indicia for displaying an expression or message. The interchangeable indicia tile interact with a word proximately displayed on the cup exterior so as to form a complete message which the cup owner wishes to convey. As an example, the indicia may include a generic face not related to any particular race or gender, which is designed to convey the cup owner's specific mood or disposition. For instance a "mood" face interacts with a word such as "Feeling" proximately displayed on the cup exterior to evince a certain mood, feeling, or condition such as "feeling happy" or "feeling sad", the particular feeling being embodied in an expression of the generic face. The indicia tile may also interact with a phrase such as, "I Love", so that a message of affinity to a particular sport, team, organization, animal, object or hobby is conveyed when the tile is inserted. Other messages may be made without departing from the scope and spirit of the instant invention. The instant invention is intended to allow its user to select any message they wish to convey and to easily change that message as they choose.

The cup is preferably fabricated from glazed ceramic for durability and washability but may be constructed from alternate materials if desired. The indicia tiles are preferably manufactured from an injection molded plastic, or other injection molded material, so that there is not any wasted material as in ceramic tile designs. The sign means conform to the cup's outer periphery and slidably engage the installation slot defined therein. The cup itself may contain an external handle on its outer periphery to facilitate holding.

Because the cup has the provision to display only one indicia tile at a time, the instant invention may also provide a coaster for mounting the cup thereon which is configured to store a plurality of indicia tile not in immediate usage. The coaster is essentially a planar base structure having elevated walls which form an enclosure with an open top end for accepting said sign means. The cup can then be placed on top of these for support, and they can be easily interchanged as desired.

In accordance with the present invention, it is an object thereof to provide a drinking vessel capable of interchangeably installing different external sign means to display various indicia.

It is another object of the instant invention to provide a drinking vessel adapted for receiving sign means which display written messages or forms of expression to convey a mood, condition, or opinion.

It is a further object of the instant invention to provide a drinking vessel adapted for receiving sign means which display generic facial caricatures which embody different human moods.

It is still a further object of the present invention to provide a drinking vessel having the aforementioned features which embodies a simple design amenable to low cost construction so as to maintain a competitive selling price.

The invention will best be understood when the aforementioned is addressed in conjunction with the hereinafter detailed component description and drawings.

DETAILED DESCRIPTION OF THE PREFERRED EMBODIMENT

Figure 1:
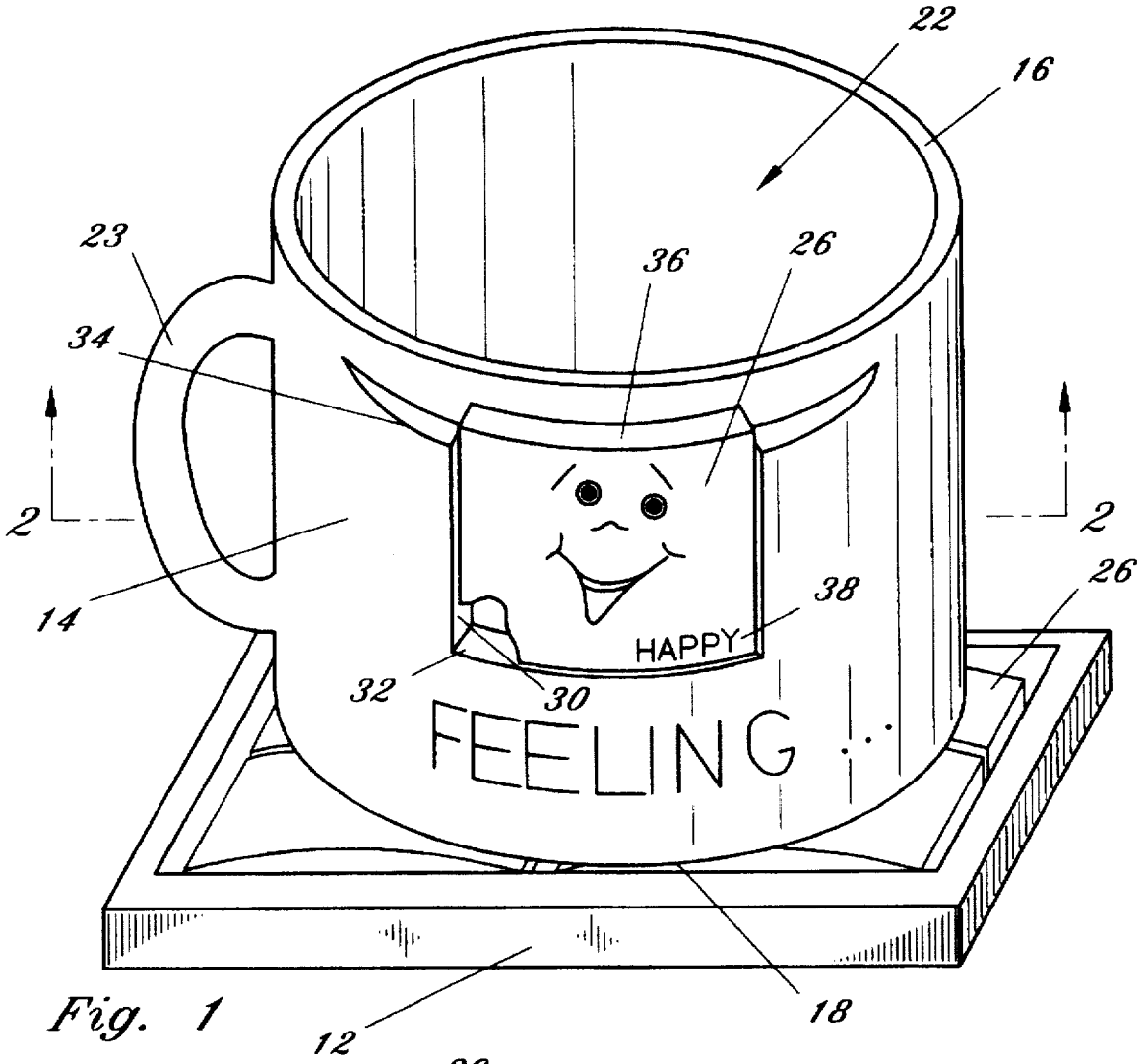
FIG. 1 is an isometric view of the cup and coaster in the preferred embodiment.

With reference to the several views of the drawing, there is depicted a mood cup 10 and coaster 12. Accordingly, the mug with interchangeable indicia tiles comprises a coffee/tea mug designed to accommodate, in a built in holder or slot, any one of a series of "mood faces" that selectively express the disposition of the user. The indicia tile comprises a plurality of injection molded tiles each sized for slidably engaging the slot and displaying a particular mood face or message which in combination with a copy line relating to the indicia relays a message or mood when the tile is in the installation slot. For instance, the line may read "Feeling . . . " and a thought is completed by the expression of the face displayed by the tile. The mug and faces can be made of ceramics, plastics or any other viable material conducive to mugs of any type, however, plastic injection molded indicia tiles are preferred.

In a first alternative embodiment, the mug of the instant invention may be shaped and designed in the form of a beer mug or other beverage mug. In a second alternative embodiment, the word "Feeling . . . " may be replaced with "Warning:" to expand an enhanced variety of human expressions that the mug mood can accommodate. A third alternative may complete the phrase "I Love" to be completed with a variety of possible displays including, but not restricted to, the family, sports, hobbies, personalities, fictitious characters, sport slicks, theme parks and businesses.

Figure 2:
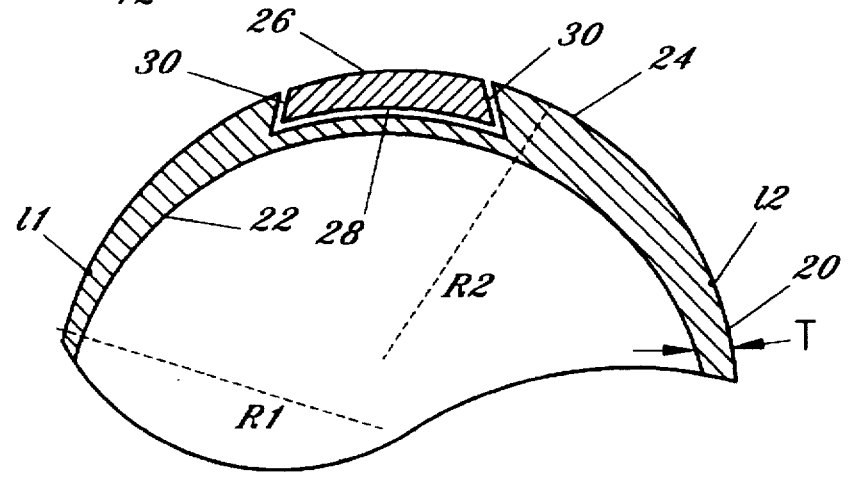
FIG. 2 is a section through the cup showing detail of the cup slot and installed sign means.

The instant invention comprises a cup 10 and a plurality of indicia tiles 26 insertable in a slot on the exterior wall of the cup 10 to convey a message based on the tile 26 selected. FIGS. 1 and 2 show a cup 10 in the preferred embodiment comprising a cylindrical vessel 14 having a top end 16 for receiving fluids therein, a slot for receiving indicia tiles 26, a base 18, and outer and inner radial surfaces 20 and 22 respectively. A handle 23 associated with said outer radial surface 20 may be provided as an option for grasping vessel 14. Said radial surfaces 20 and 22 define a nominal wall thickness T. The outer radial surface 20 has a radius R1 which is coincident with vessel 14's axial centerline, and a corresponding inner radial surface 22 is defined by R1 minus T. An eccentric outer radial periphery 24 may be provided to increase the wall thickness in a portion of the vessel so that the tile acceptance slot for housing the tile means 26 may be easily accommodated. Radial periphery 24 is defined by radius R2 which has its center of rotation offset from vessel 14's axial centerline such that an increase in wall thickness is realized between the radial locations where R1 intersects R2, shown in FIG. 2 as i1 and i2. The eccentric radial surface 24 can extend the entire length of vessel 14 from the bottom end 18 to the top end 16, or it can terminate below the top end in a shoulder portion 34 as shown in FIG. 1. This facilitates grasping the sign means 26 at end 36 for easy removal when replacement with another sign means is desired. However, the wall thickness T and radial surface 24 may be uniform and constant throughout the outer radial surface 20 without varying so long as the acceptance slot may be formed.

Each of the indicia tile means 26 slidably engages the slot. The slot comprises a rear wall 28, side walls 30 and base wall 32. The rear wall 28 is formed by offsetting radius R2 diametrically inward, so as to form a slot and sign means thickness equal to the width of base wall 32. Base wall 32 is formed on a plane which is parallel to top and bottom ends 16 and 18 respectively, and normal to the vessel centerline. Side walls 30 taper inward from the rear wall to the outer radial surface, 20 or 24, such that a positive mechanical lock occurs between sign means 26 and said slot walls upon engagement of the tile 26 to prevent any undesired movement therebetween. The side walls 30 and rear wall 28 define an open top end or sleeve for receiving or passing the tiles 26. The open top end of the slot begins proximal to or at the top end of the cup 10 so that nothing can obstruct the insertion and removal of indicia tiles 26. A shelf may also be integrally formed on the exterior wall on each side of each side wall 30 to effect easier tile transfers.

Figure 5:
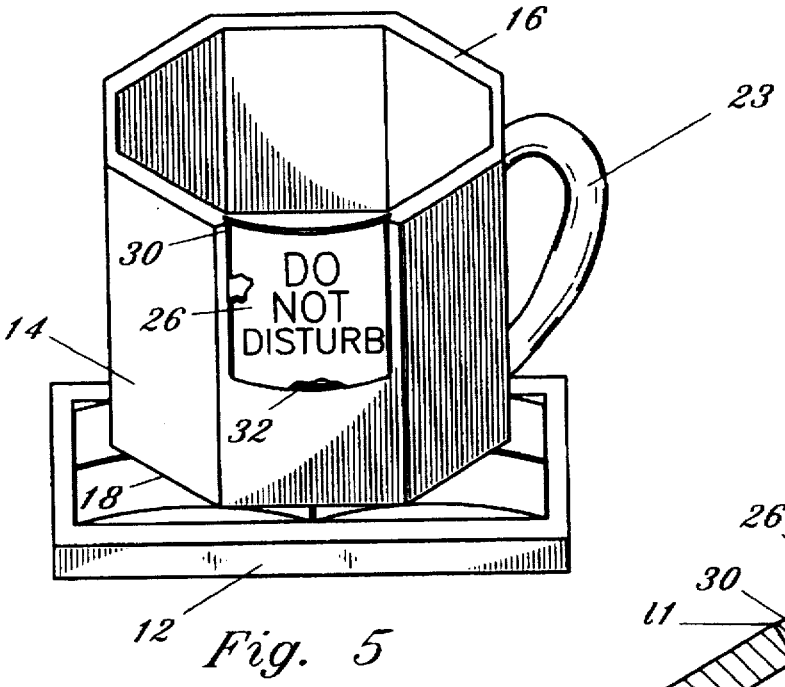
FIG. 5 is an isometric view of the cup in still another embodiment.
Figure 7:
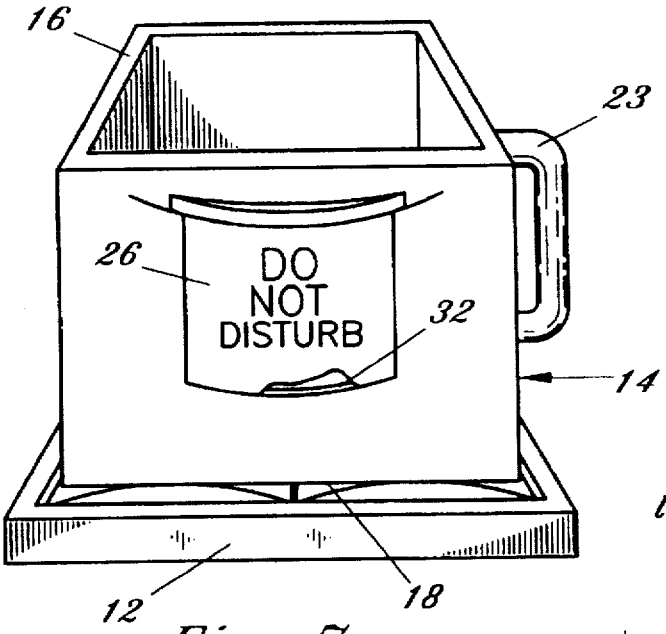
FIG. 7 is an isometric view of the cup in yet another embodiment.

The indicia tiles 26 comprise an annular element having substantially the same dimensions as the aforementioned slot walls, but which are downsized accordingly so that indicia tiles 26 slip fit within said slot confines to facilitate ease of interchangability. Each indicia tile 26 has an outer radial contour adapted to blend smoothly with vessel outer radial eccentric periphery 24, or 20, said contour further has indicia 38 disposed thereon for expressing a given mood, human disposition, or message. A line which for means of example reads "Feeling . . . " is proximately disposed relative to sign means 26 when in an installed position, so as to interact with the expressions currently being displayed. The indicia may comprise generic faces or caricatures which are not related to any gender, race or nationality, and which visually describe the particular mood of the owner such as being "happy", "sad", "angry", "tired", or "sick". Alternatively, the indicia may comprise a simple message such as for purposes of illustration, "Do Not Disturb" as shown in FIGS. 5 and 7. The vessel 14 may be fabricated from glazed ceramic for durability and washability, however substitutions of other materials may be made within the scope of the invention. The indicia tile 26 may also be ceramic but it is preferred that the tiles 26 be made form an injection molded plastic so that no material is wasted. Injection molding also eliminates the expense of silk screen printing.

Figure 3:
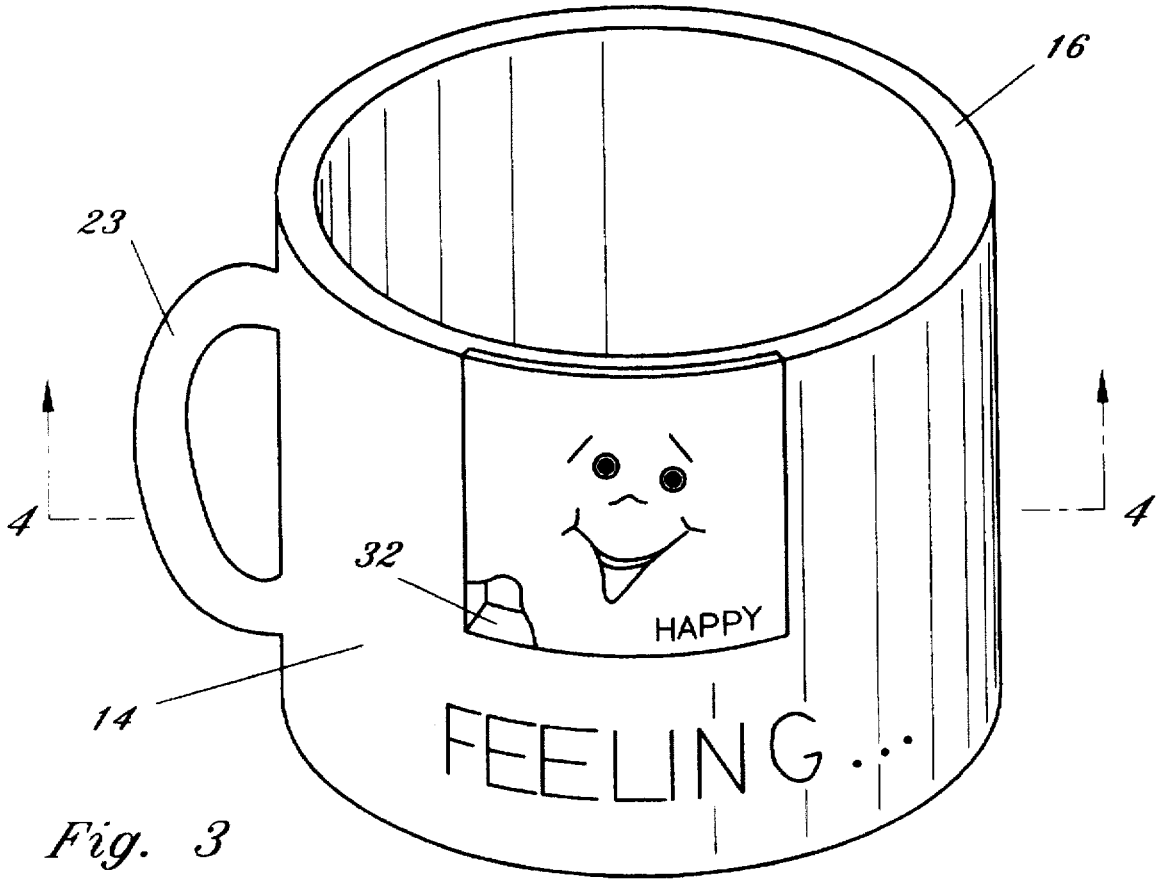
FIG. 3 is an isometric view of the cup in an alternative embodiment.
Figure 4:
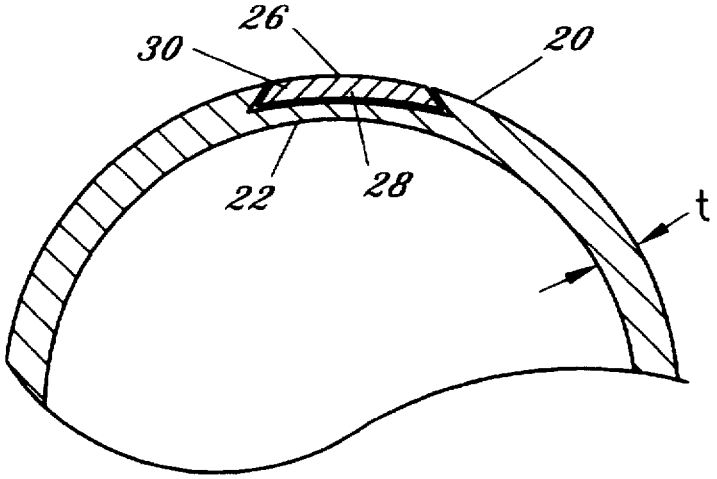
FIG. 4 is a section through the cup showing detail of the cup slot and installed sign means in the alternative embodiment.

In an alternative embodiment depicted in FIGS. 3 and 4, the eccentric radial periphery 24 is omitted leaving vessel 14' with a constant radial wall thickness T. In this embodiment, the indicia tiles 26' are of similar construction to 26 but with a thinner wall thickness equal to the planar width of base wall 32'. Slot/sign means side walls 30' and back wall 28' are downsized accordingly. If desired, this embodiment provides the cup with a more uniform aesthetic appearance since there is no eccentric radial periphery 24 to interrupt the constant radial contour of vessel outer surface 20.

Figure 6:
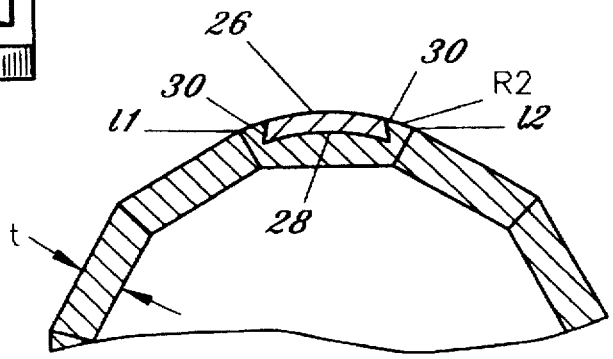
FIG. 6 is a section through the cup showing detail of the cup slot and installed sign means in the alternative embodiment.

In yet another embodiment depicted in FIGS. 5 and 6, vessel 14" is octagonal with respect to planes normal to its axial centerline. Similar to the preferred embodiment, eccentric outer radial periphery 24" is provided to increase the wall thickness in a portion of the vessel so that an acceptance slot for sign means 26" may be easily accommodated. Radial periphery 24" is defined by locating R2" eccentric to vessel 14"'s axial centerline such that an increase in wall thickness is realized between the radial locations i1" and i2" where adjacent octagonal faces intersect. Sign means 26" are adapted to slidably fit within slot side walls 30", back wall 28", and base wall 32".

Figure 8:
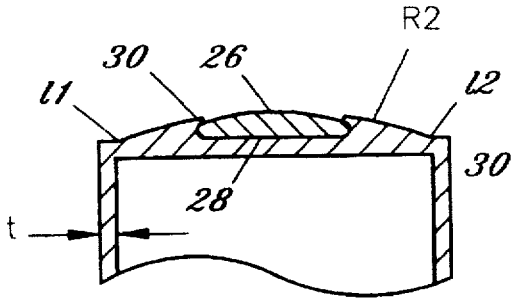
FIG. 8 is a section through the cup showing detail of the cup slot and installed sign means in yet another embodiment.

In still another embodiment illustrated in FIGS. 7 and 8, vessel 14'" is quadrilateral with respect to planes normal to its axial centerline. Eccentric outer radial periphery 24'" is provided to increase the wall thickness in a portion of the vessel as discussed hereinbefore. Sign means 26'" are adapted to slidably engage slot side walls 30'", back wall 28'", and base wall 32'". If desired, the built up radial wall thickness defined in this and the prior embodiments generally as R2, may have any shape capable of increasing the wall thickness substituted therefor.

Figure 9:
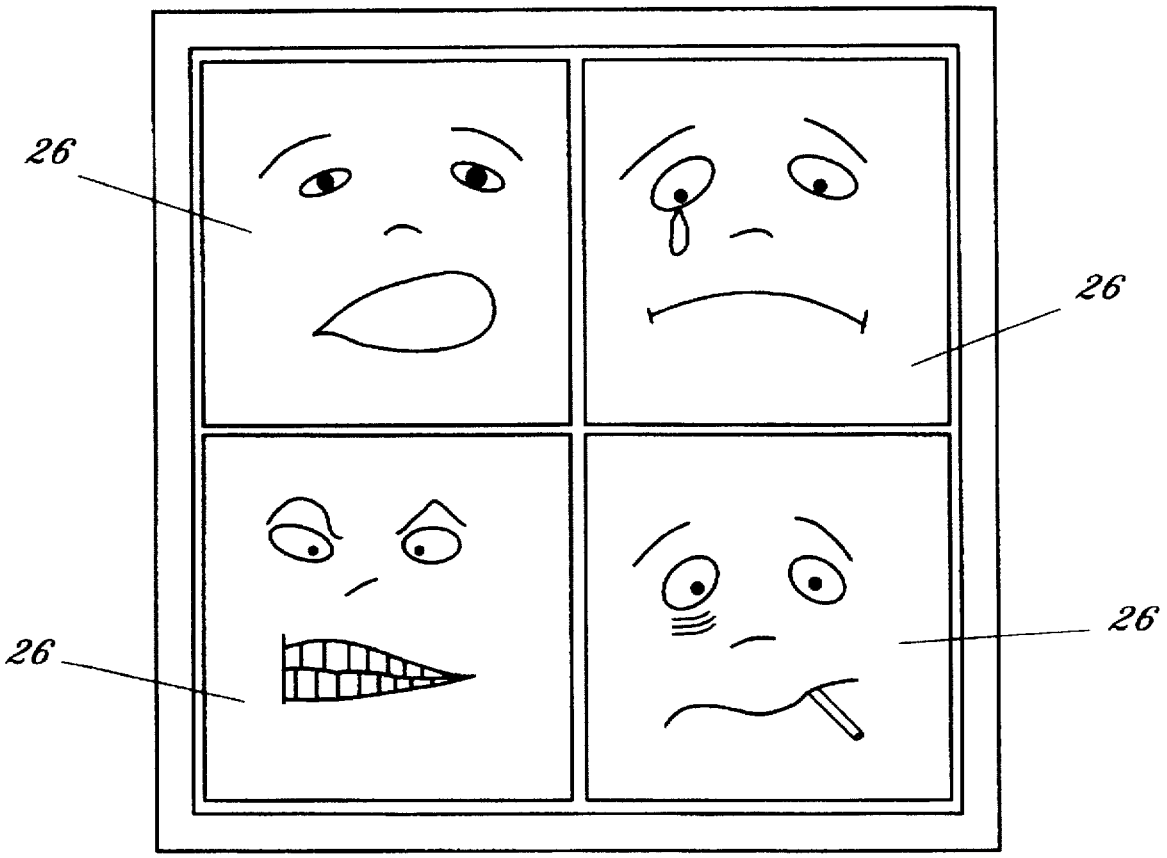
FIG. 9 is a plan view of the coaster assembly storing four (4) sign means.
Figure 10:
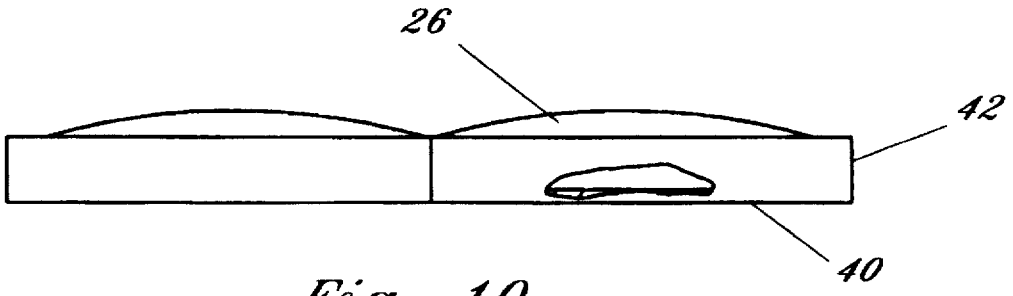
FIG. 10 is an elevational view of the coaster assembly.

FIGS. 9 and 10 depict the coaster assembly 12, also shown with a mood cup 10 thereupon in FIG. 1. The coaster 12 is an open-ended structure having a base 40 and vertical walls 42 normal thereto, and is adapted to receive sign means 26 which are not mounted on vessel 14 such that the stored sign means and base structure cooperatively provide a support surface for the mug 10. The sign means 26 are disposed within coaster 12 such that they be easily removed from storage and interchanged with the current sign means installed in vessel 14. When the mug owner feels his or her mood, situation, or condition change, and so desires to make it known to those in close proximity, the owner simply removes current sign means 26 slidably from vessel 14, and replaces it with an alternate stored within coaster 12.

The invention described herein has been shown in what is considered the most practical embodiments. It is anticipated that departures may be made therefrom within the scope of the invention and that obvious modifications will be implemented by a person skilled in the art.

What I claim is:

1. A mug for conveying selected messages, said mug comprising:

a vessel having an outer surface and an inner surface defining a nominal wall thickness therebetween, said wall thickness extending upward from a closed bottom end a predetermined height and forming an open top end for receiving fluent materials therein;

a slot opening defined by a portion of said wall thickness removed from said outer surface;

a plurality of interchangeable tiles each having dimensions corresponding to said slot for slidable engagement with said slot and each bearing a different indicia for conveying a selected message, each said tile having an exterior surface bearing said indicia for displaying said indicia from within said slot, said tiles adapted to be slidably and removably disposed in said slot, said slot having an open top end proximal said vessel open top end to facilitate convenient insertion and removal of said tiles from said slot;

means for slidably securing said tiles in said slot, said securing means being defined by said slot and each said tile for permitting slidable insertion and removal of said tiles; and means for storing said tiles, said storing means comprising a substantially planar base structure and elevated walls extending from said base structure to form an enclosure defining a volume adapted for receiving and storing said tiles, said enclosure further providing a support surface for mounting said mug thereon.

2. The mug recited in claim 1 wherein said vessel is substantially cylindrical.

3. The mug recited in claim 1 wherein said vessel is substantially octagonal.

4. The mug recited in claim 1, wherein said vessel is substantially quadrilateral.

5. The mug recited in claim 1 wherein said tile indicia comprise a plurality of different generic mood faces adapted to express a particular human disposition or condition.

6. The mug recited in claim 5 further comprising a cup indicia disposed on said outer surface for conveying a message in combination with said tile indicia when one of said tiles is inserted in said slot.

7. The mug recited in claim 1 wherein said tile indicia comprise a plurality of written messages adapted to express a particular human disposition or condition.

8. The mug recited in claim 1 wherein said wall thickness is thicker in the vicinity of said slot such that a built-up wall thickness is formed so as to accommodate formation of said slot.

9. The mug recited in claim 1, further comprising a handle projecting from said outer surface to facilitate grasping.

10. The mug recited in claim 1 wherein said slot comprises an open front side substantially in alignment with said outer surface, said open front side being defined by an opposing rear wall formed in said wall thickness between said inner surface and said outer surface, a base wall formed in said wall thickness below said slot open top end, and opposing side walls joining said outer surface with said rear wall and said base wall with said slot open top end.

11. The mug recited in claim 1, wherein said tiles comprise an injected molded plastic for preventing any waste of material during manufacturing.

12. The mug recited in claim 10, wherein said side walls are tapered and each said tile has corresponding tapered side edges, said side walls converging from said rear wall to said outer surface so as to permit slidable engagement of said tile in said slot, said securing means comprising said tapered side walls and said tile side edges.

13. A mug for conveying selected messages, said mug comprising:

a vessel having an outer surface and an inner surface defining a nominal wall thickness therebetween, said wall thickness extending upward from a closed bottom end a predetermined height to form an open top end for receiving fluids therein;

a slot defined by a portion of said wall thickness removed from said outer surface, said slot comprising an open top end substantially contiguous with said vessel open top end, an open front side in substantial alignment with said outer surface, a rear wall opposing said open front side and being formed between said inner surface and said outer surface, a base wall below said slot open top end, and side walls joining said open front side with said rear wall and said slot open top end with said base wall, said side walls converging from said rear wall toward said outer surface so as to interchangeably and mechanically lock tiles in said slot and permit slidable insertion and removal of said tiles from said slot, said side walls and said base wall defining said open front side;

said tiles comprising a plurality of interchangeable tiles each bearing a different indicia for conveying a selected message, each said tile having an exterior surface bearing said indicia for displaying said indicia from within said slot and through said open front side, said tiles adapted to be slidably and removably disposed in said slot, said slot open top end facilitating convenient insertion and removal of said tiles; and a handle associated with said outer surface to facilitate grasping.

14. The mug recited in claim 13 wherein said indicia comprise a plurality of written messages adapted to express a particular human disposition, condition, or opinion.

15. The mug recited in claim 13 wherein said vessel is substantially cylindrical.

16. The mug recited in claim 13 wherein said vessel is substantially octagonal.

17. The mug recited in claim 13 wherein said vessel is substantially quadrilateral.

18. The mug recited in claim 13 wherein said wall thickness is thicker in the vicinity of said slot such that a built up wall thickness is formed so as to accommodate formation of said slot.

19. The mug recited in claim 13 further comprising a means for storing said tiles, said storing means comprising:

an enclosure defining a volume adapted for receiving and storing said tiles, said enclosure having an exterior support surface for mounting said mug thereon.

20. The mug recited in claim 13, wherein said tiles comprise an injected molded plastic for preventing any waste of material during manufacturing.

21. The mug recited in claim 13 further comprising a cup indicia disposed on said outer surface for conveying a message in combination with said tile indicia when one of said tiles is inserted in said slot.

* * * * *